US005154428A

United States Patent [19]

Woolhouse

[11] Patent Number: 5,154,428

[45] Date of Patent: Oct. 13, 1992

[54] MILITARY GAME APPARATUS

[76] Inventor: Charles J. Woolhouse, 15479 182nd Ave., Elk River, Minn. 55330

[21] Appl. No.: 732,613

[22] Filed: Jul. 19, 1991

[51] Int. Cl.[5] ..... A63F 3/00

[52] U.S. Cl. ..... 273/265; 273/313; 273/289

[58] Field of Search ..... 273/262, 265, 285, 289, 273/313, 314, 351

[56] References Cited

U.S. PATENT DOCUMENTS

| | | | |
|---|---|---|---|
| 2,053,598 | 9/1936 | Blau | 273/265 |
| 2,794,641 | 6/1957 | Baker et al. | 273/265 |
| 4,194,742 | 3/1980 | Adams | 273/265 |
| 4,280,704 | 7/1981 | Massimei et al. | 273/262 X |
| 4,801,148 | 1/1989 | Lamb | 273/265 X |

FOREIGN PATENT DOCUMENTS

| | | | |
|---|---|---|---|
| 2814740 | 10/1978 | Fed. Rep. of Germany | 273/265 |
| 2513893 | 4/1983 | France | 273/262 |
| 0224182 | 11/1924 | United Kingdom | 273/262 |
| 1436453 | 5/1976 | United Kingdom | 273/285 |
| 1527493 | 10/1978 | United Kingdom | 273/262 |

*Primary Examiner*—Paul E. Shapiro
*Assistant Examiner*—William M. Pierce
*Attorney, Agent, or Firm*—Leon Gilden

[57] ABSTRACT

A housing assembly includes a first housing hingedly mounted to a second housing, wherein each housing includes a first inner wall playing field, with a second playing field relative to each first playing field pivotally mounted thereto, with each first playing field including a plurality of wings hingedly mounted thereto, wherein each wing is pivotal from a first horizontal position to a second vertical position relative to the first playing field, wherein adjacent pairs of first wing upper edges are cooperative with respective upper edges of the second playing fields to receive "T" shaped locking members to secure the playing fields together. Each first playing field includes a first grid, and the second playing field includes a second grid, wherein the second grid includes apertures corresponding to first grid spaces for receiving indicator pegs therewithin. Field pieces includes various first, second, and third tokens representing various military articles initially positionable as desired, with the first token representative of a tank configuration displaceable along the first playing field of each player during play of the game. A modification of the invention includes the second playing piece configured as an artillery and operative as a catapult to project various projectile members against an opposing first token for a deadlock game or to expedite termination of a game to attempt to strike the first, and particularly the third, tokens of an opposing player.

1 Claim, 5 Drawing Sheets

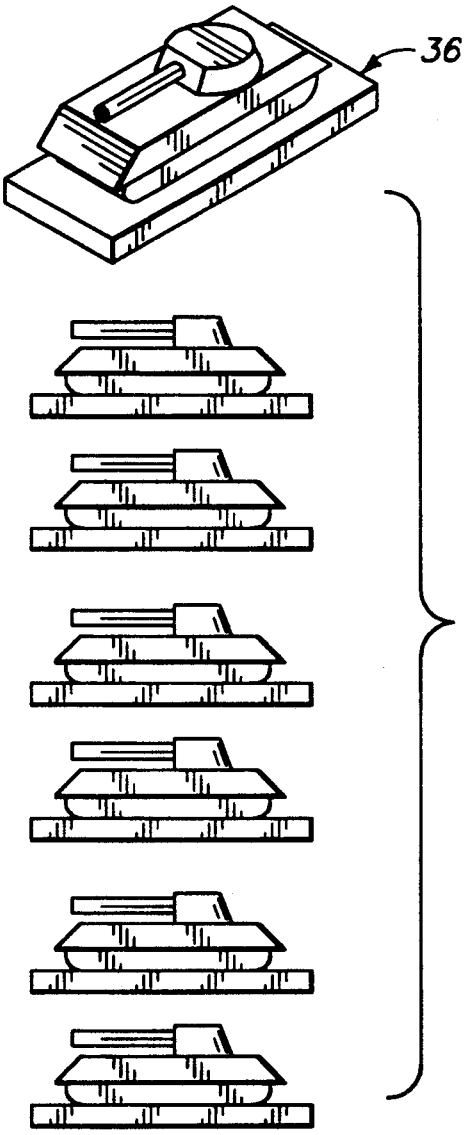
Fig 4
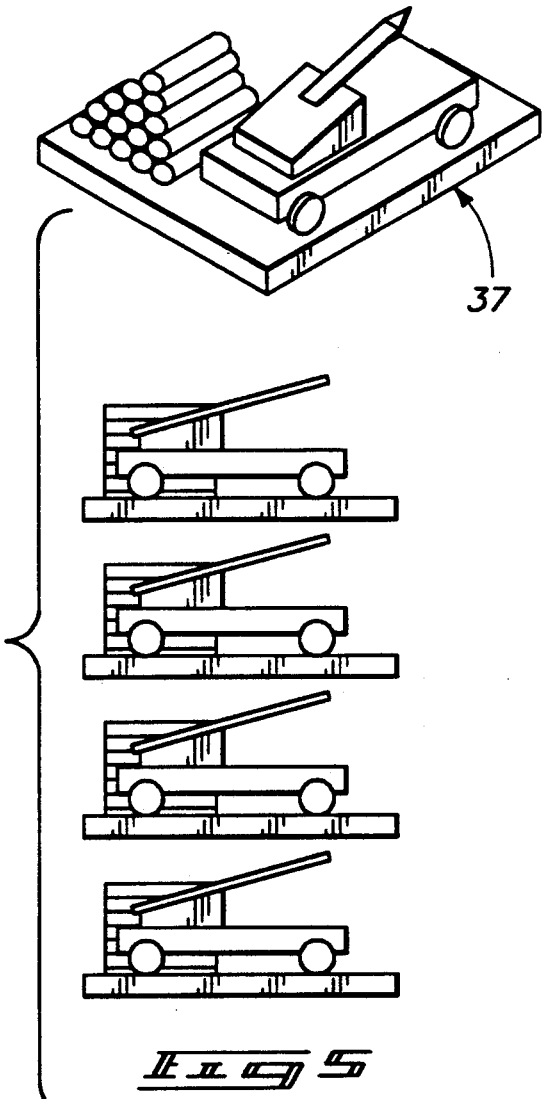
Fig 5
Fig 6
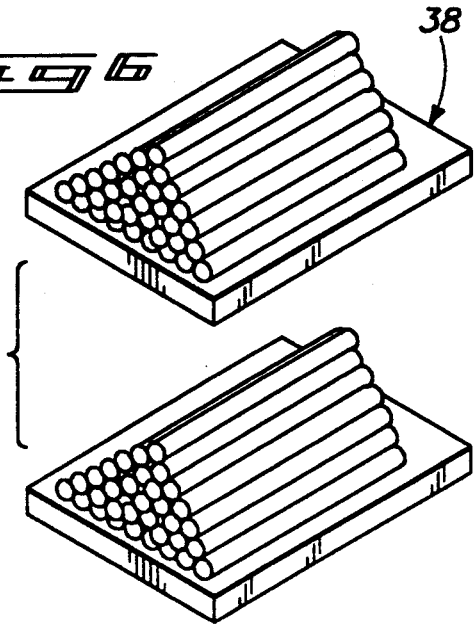
Fig 7
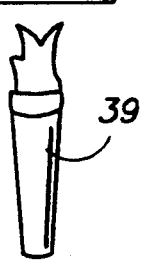
Fig 8
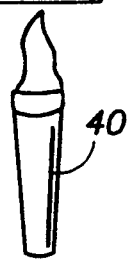

Fig 9
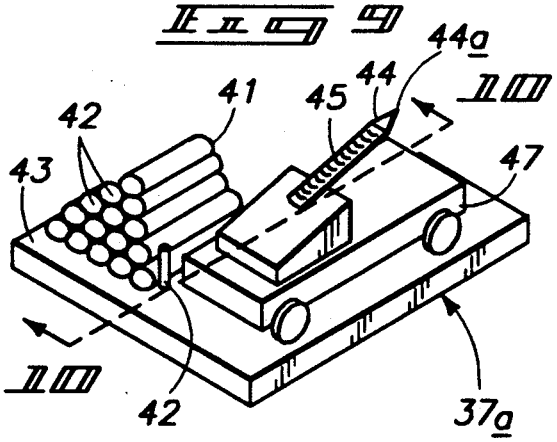
Fig 10
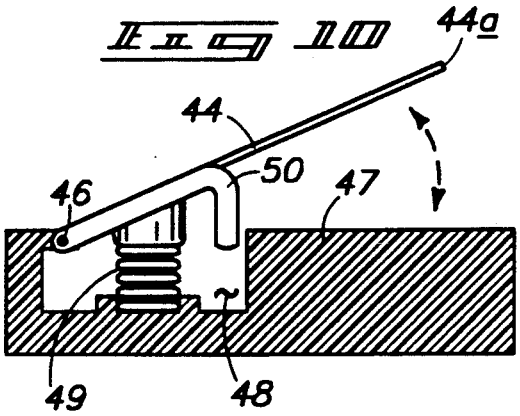
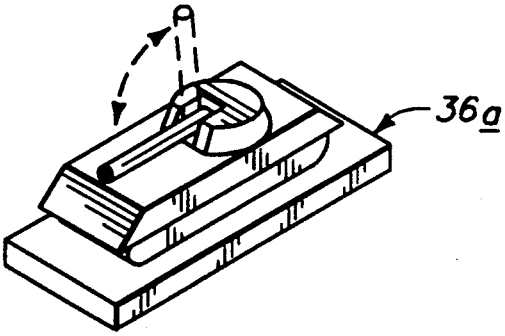
Fig 11
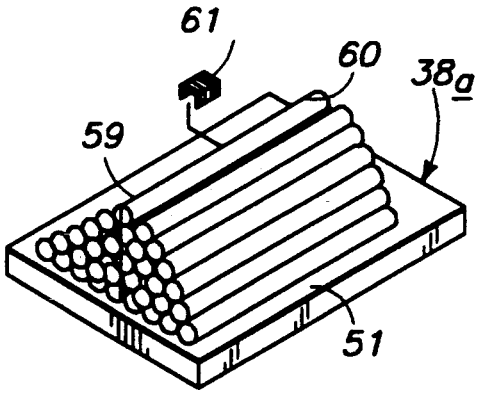
Fig 12
Fig 13
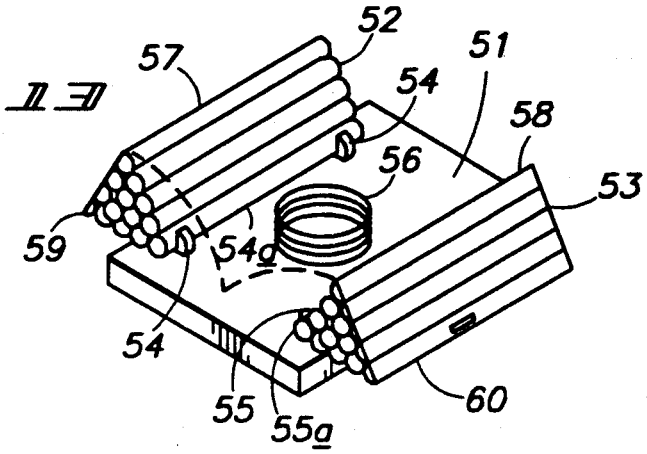

MILITARY GAME APPARATUS

BACKGROUND OF THE INVENTION

1. Field of the Invention

The field of invention relates to game apparatus, and more particularly pertains to a new and improved military game apparatus wherein the same is arranged to effect simulation of maneuverability of military hardware during military action.

2. Description of the Prior Art

Various military type games of various configuration are utilized in the prior art. Such games are typified and exemplified by U.S. Pat. No. 4,280,704 to Massimei, et al. wherein a military type board game includes opposing first and second playing fields operative to track and contain various opposing playing pieces.

U.S. Pat. No. 4,093,236 to Hoffa sets forth a wargame type construction wherein each player game piece includes performance data established for it to include maneuvering and imaginary exchange of fire between opposing game pieces utilizing performance data.

U.S. Pat. No. 3,989,254 to Cooper sets forth a battle-type game apparatus including simulated tanks maneuverable throughout the game.

U.S. Pat. No. 4,221,389 to Read sets forth a war game apparatus utilizing a game board including gun pieces and other type military representative tokens.

As such, it may be appreciated that there continues to be a need for a new and improved military game apparatus as set forth by the instant invention which addresses both the problems of ease of use as well as effectiveness in construction in permitting play and expediting of a game to simulate military maneuverability and in this respect, the present invention substantially fulfills this need.

SUMMARY OF THE INVENTION

In view of the foregoing disadvantages inherent in the known types of military game apparatus now present in the prior art, the present invention provides a military game apparatus wherein the same utilizes a readily erected game board component cooperative to receive opposing military tokens in simulating military maneuverability in warfare. As such, the general purpose of the present invention, which will be described subsequently in greater detail, is to provide a new and improved military game apparatus of the prior art military game apparatus and none of the disadvantages.

To attain this, the present invention provides a housing assembly including a first housing hingedly mounted to a second housing, wherein each housing includes a first inner wall playing field, with a second playing field relative to each first playing field pivotally mounted thereto, with each first playing field including a plurality of wings hingedly mounted thereto, wherein each wing is pivotal from a first horizontal position to a second vertical position relative to the first playing field, wherein adjacent pairs of first wing upper edges are cooperative with respective upper edges of the second playing fields to receive "T" shaped locking members to secure the playing fields together. Each first playing field includes a first grid, and the second playing field includes a second grid, wherein the second grid includes apertures corresponding to first grid spaces for receiving indicator pegs therewithin. Field pieces include various first, second, and third tokens representing various military articles initially positionable as desired, with the first token representative of a tank configuration displaceable along the first playing field of each player during play of the game. A modification of the invention includes the second playing piece configured as an artillery and operative as a catapult to project various projectile members against an opposing first token for a deadlock game or to expedite termination of a game to attempt to strike the first, and particularly the third, tokens of an opposing player.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved military game apparatus which has all the advantages of the prior art military game apparatus and none of the disadvantages.

It is another object of the present invention to provide a new and improved military game apparatus which may be easily and efficiently manufactured and marketed.

It is a further object of the present invention to provide a new and improved military game apparatus which is of a durable and reliable construction.

An even further object of the present invention is to provide a new and improved military game apparatus which is susceptible of a low cost of manufacture with regard to both materials and labor, and which accordingly is then susceptible of low prices of sale to the consuming public, thereby making such military game apparatus economically available to the buying public.

Still yet another object of the present invention is to provide a new and improved military game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric representation of the first tokens utilized by the opposing players.

FIG. 5 is an isometric illustration and representative orthographic tokens of a second token member utilized by each player.

FIG. 6 is an isometric illustration of the ammunition or third token supply utilized by each player.

FIG. 7 is an orthographic representation of a first peg member utilized by the players.

FIG. 8 is an orthographic representation of the second pegs utilized by each player.

FIG. 9 is an isometric illustration of a modified second token utilized by the instant invention.

FIG. 10 is an orthographic view, taken along the lines 10—10 of FIG. 9 in the direction indicated by the arrows.

FIG. 11 is an isometric illustration of a modified second token utilized by the instant invention.

FIG. 12 is an isometric representation of a modified third token utilized by the invention.

FIG. 13 is an isometric representation of the third token in an opened configuration.

DESCRIPTION OF THE PREFERRED EMBODIMENT

Figure 1:
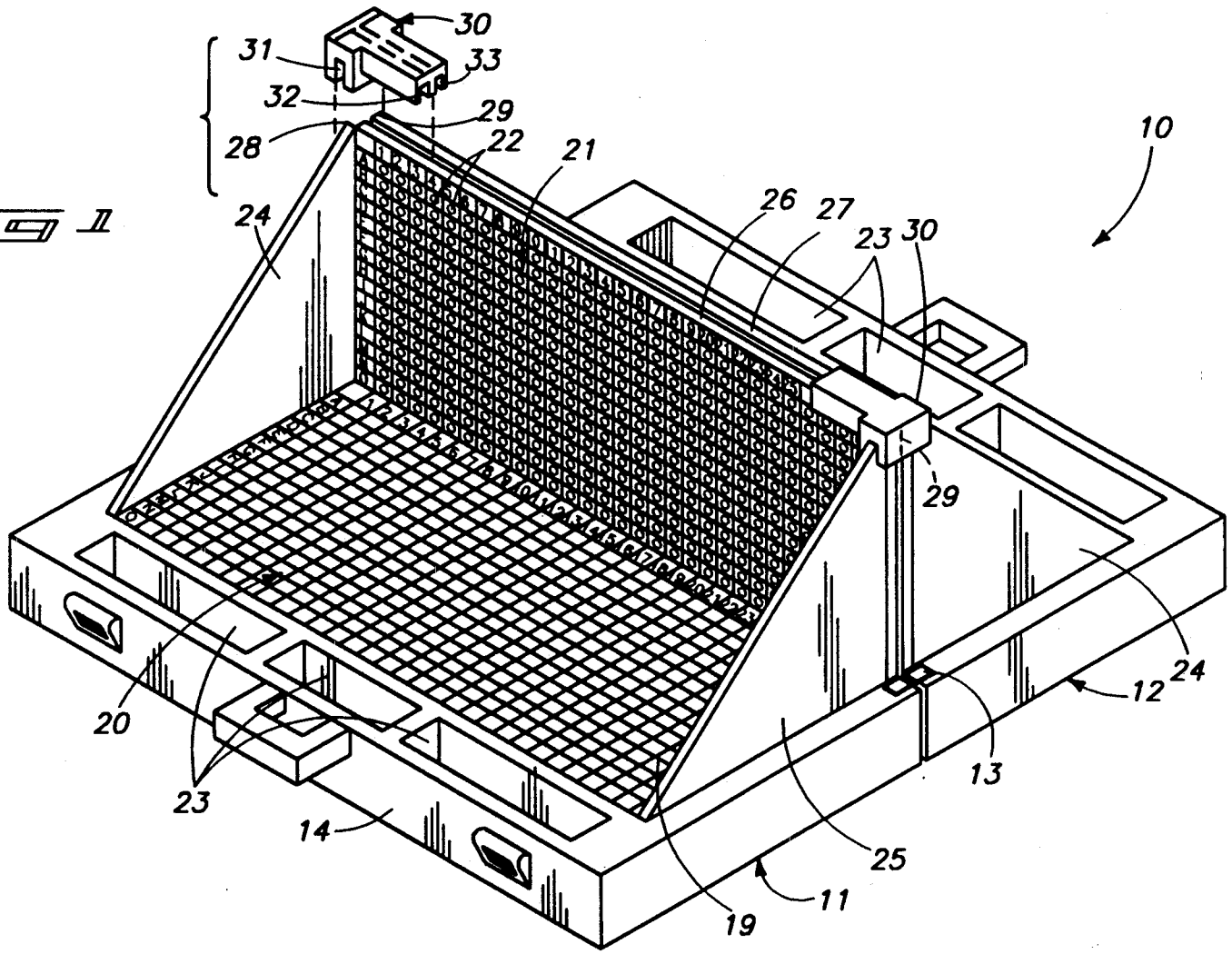
FIG. 1 is an isometric illustration of the board construction of the instant invention.

With reference now to the drawings, and in particular to FIGS. 1 to 13 thereof, a new and improved military game apparatus embodying the principles and concepts of the present invention and generally designated by the reference numeral 10 will be described.

Figure 2:
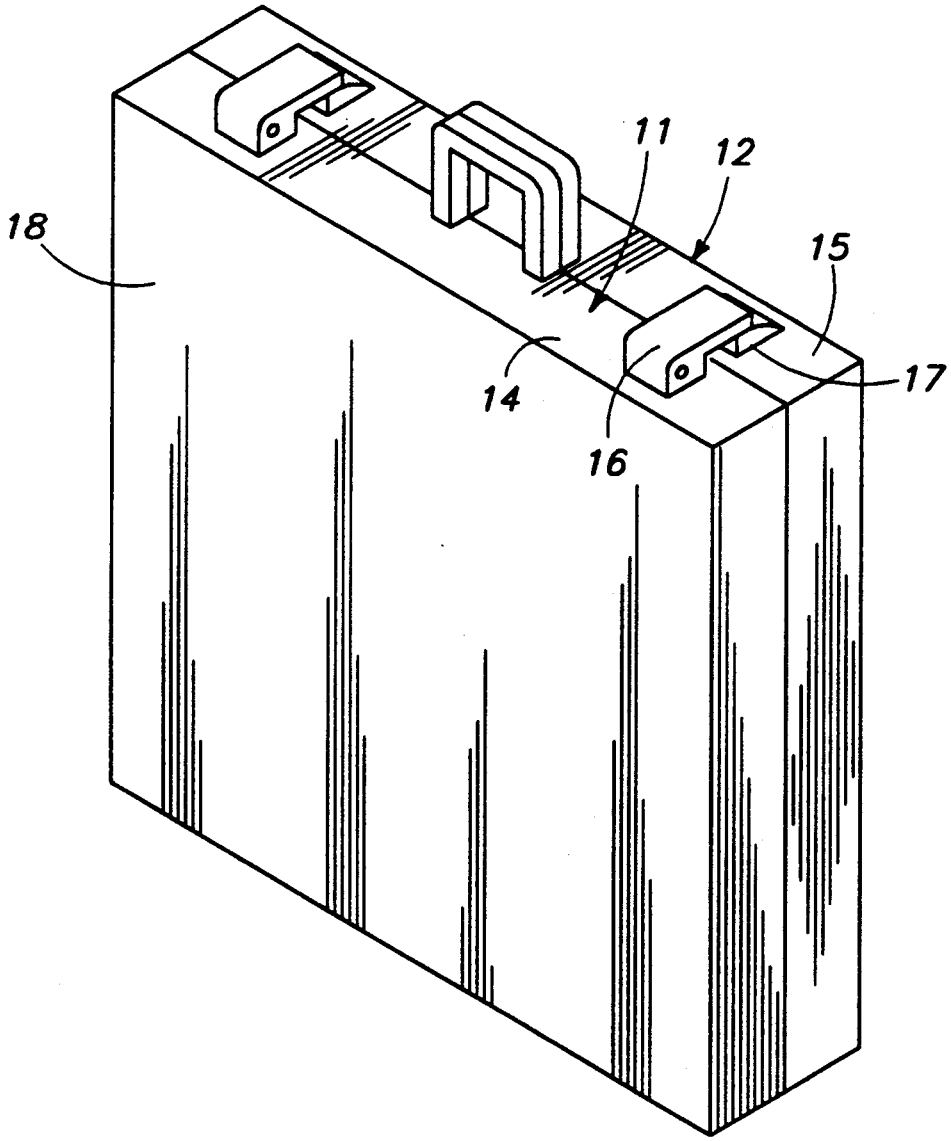
FIG. 2 is an isometric illustration of the housing assembly in a closed configuration.

More specifically, the military game apparatus 10 of the instant invention essentially comprises a housing assembly, including a first support housing 11 hingedly mounted to a second support housing 12 by a plurality of hinge members 13. Each respective first and second support housing 11 and 12 includes a respective first and second housing front wall 14 and 15, each including a handle, and each including a respective first and second housing latch 16 and 17 securable together to align and secure the first and second housing front walls 14 and 15 in a coplanar relationship, as illustrated in FIG. 2. When opened to the second configuration, as illustrated in FIG. 1, the housings 11 and 12 each include a housing outer side wall 18 spaced from and parallel a housing inner side wall 19. The inner wall 19 includes an inner wall playing field 20 defining a rectangular grid, including a predetermined number of first rows and first columns defining a matrix of first spaces. An inner wall second playing field 21 is hingedly mounted to the first playing field 20 at a lower terminal end of the second playing field, and includes an equal predetermined number of second rows and second columns defining second spaces equal to the predetermined number of first spaces. Each second space includes a peg receiving aperture 22 positioned medially thereof. The second playing field 21 of each respective first and second housing 11 and 12 is arranged for receiving a second peg 40 or first peg 39. Each player is afforded at least 200 of the second pegs 40 to indicate a called second space by an opposing player. A first peg 39 is utilized to indicate a strike by a called space. Accordingly, each of the second spaces is associated with a like first space, wherein each of the rows and columns of the first and second spaces are marked identically utilizing indicia such as letters and numbers to provide referencing to each space of each respective grid thusly defined.

Each respective first and second housing 11 and 12 further includes a plurality of compartments 23 that are positioned between the first playing field 20 of each housing and each respective front wall 14 and 15. Each of the compartments are arranged to receive the various tokens and pegs utilized in playing of the game of the instant invention.

Figure 3:
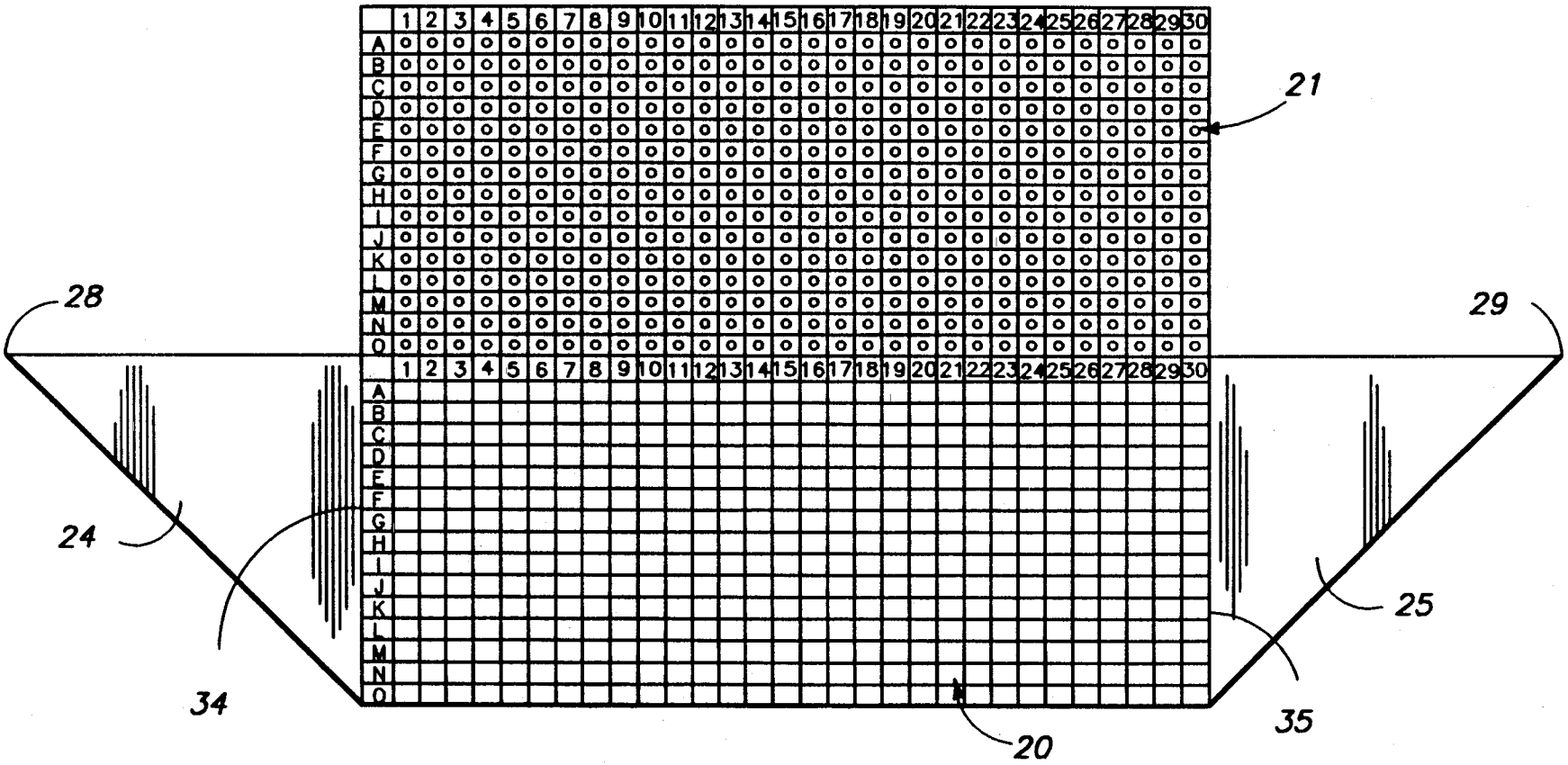
FIG. 3 is a top orthographic view of each player's first and second playing field utilized in the invention.

It should be further noted that each first playing field includes a respective first and second wing flange 24 and 25 respectively hingedly mounted to each first playing field, wherein each respective wing flange 24 and 25 includes a respective first and second wing upper edge 28 and 29 that are aligned with the first and second upper edge 26 and 27 of each respective second playing field 21 of each housing. When thusly aligned, a "T" shaped locking member 30 is received by the intersection of a first and second upper edge 26 and 27 and a first wing and second wing upper edge 28 and 29. The "T" shaped locking member includes a first channel 31 aligned to receive the first and second wing upper edges 28 and 29, with parallel second and third channels 32 and 33 orthogonally intersecting the first channel 31 arranged for receiving respective upper edges 26 and 27 to thereby latch the first and second playing field of each housing in an orthogonal relationship, as illustrated in FIG. 1. It should be further noted that the first and second wing flanges 24 and 25 are hingedly mounted by first and second wing hinges 34 and 35 coextensively with opposing sides of the first playing field 20, in a manner as illustrated in FIG. 3.

Tokens utilized in the game include a first token 36 configured as a tank to be configured of a first token length equal to a spacing substantially equal to two of the first spaces. A second token 37 defined as an artillery member is of a second token length equal to a length defined by three of the first spaces, wherein a third token 38 defining an ammunition supply is of a third token length equal to four spaces of the first spaces of the first playing field 20. In this manner, each player is provided three first tokens, two second tokens, and a single third token. In play of the game, the third token may receive four direct hits when positioned upon the grid defined by the first playing field and upon the third token being struck four times, the calling player is declared the winner regardless of remaining tokens on the playing boards. The first token defined by two first spaces in length may receive two hits, whereas the second token defined by three spaces may receive three hits utilizing the first peg 39 for such indicia indicating such hits. It should be noted that the first token 36 of each player may be manipulated about the playing field 20 during play of the game to permit repositioning of each first token 36. Further, each player should be afforded a sufficient quantity of the first and second pegs 39 and 40 to provide each player at least fifty first pegs 39 and ostensibly two hundred of the second pegs 40 to provide each player with adequate pegs for positioning within the second playing field 21 of each housing 11 and 12.

Modified first, second, and third tokens 36*a*, 37*a*, and 38*a* are provided, as illustrated in the FIGS. 11, 9, and 12 respectively. The modified tokens may be utilized by opposing players to assist in termination of a game as desired by opposing players due to restraints of time limitations and the like. In this manner, to play such a "sudden death" termination of a game, the first and third tokens are utilized, wherein each opposing player utilizes a modified second token 37*a* to strike an opponents modified third token 38*a*. The first token 36*a* includes a plurality of projectiles 41 defined by a predetermined length, with the projectiles 41 positioned upon a first base plate 43. The first base plate 43 includes a plurality of positioning legs 42 spaced apart a sufficient spacing to receive the projectiles 41 in a stacked relationship. A catapult lever 44 includes an elongate concave surface 45 defined by a length equal to the predetermined length to receive a projectile 41 thereon. The concave surface 45 is positioned below the catapult lever's upper end 44*a*, with a hinge axle 46 directed through the catapult lever 44 at a lower end within a carriage block 47 mounted upon the first base plate 43. The carriage block 47 is defined by a predetermined height and includes a cavity 48 directed therewithin. The cavity 48 includes a spring member 49 to abut a bottom surface of the catapult lever 44 between the hinge axle 46 and the upper end 44*a*. The spring member 49 is received within the cavity, as well as an abutment leg 50 to be mounted to a bottom surface of the catapult lever to limit pivotment of the catapult lever 44 relative to the carriage block 47. The abutment leg 50 is defined by a predetermined length equal to or greater than the predetermined height of the carriage block 47. A projectile 41 is thereafter positioned upon a concave surface 45 and directed at an opposing player's third token 38. The third token 38 includes a third token base plate 51 mounting a first and second triangular polygonal member 52 and 53 thereon about respective first and second hinges 54 and 55, wherein the hinges are mounted to the third base plate 51 to respective first and second polygon's first apex 54*a* and 55*a*. A third token spring 56 is positioned medially of the first and second hinges 54 and 55 on the third base plate, wherein pivotment of the first and second triangular polygons 52 and 53 together to position the first and second polygons' second apex edges 57 and 58 and the first and second polygons' third apex edges 59 and 60 in contiguous communication relative to one another, and including a "U" shaped clip 61 surmounting the first and second polygons' third apex edges 59 and 60. A projectile directed from an opposing player's second token 37*a* impacting the opponent's third token 38*a* effects loosening of the "U" shaped clip 61 from the first and second triangular polygons 52 and 53 and thereby effects opening of the third token to a second position, as illustrated in FIG. 13, wherein the first and second triangular polygon members 52 and 53 are separated, as opposed to the first position, as illustrated in FIG. 12, wherein the first and second polygons 52 and 53 are in a contiguous coextensive relationship. In this manner, the first player in the "sudden death" time frame to effect the opponents third token 38 to open to the second position is declared a winner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A military game apparatus, comprising, a housing assembly, the housing assembly including a first support housing and a second support housing, wherein the first support housing pivotally mounts the second support housing, wherein the first support housing and the second support housing each include a housing outer side wall spaced from a housing inner side wall, and the housing outer side wall and the housing inner side wall of each support housing of said first and second support housings are arranged in a parallel relationship when the housing assembly is in a first closed configuration, and the housing inner side wall of each housing of said first and second support housings are in a coplanar relationship when the housing assembly is in opened configuration, and each housing inner side wall includes a first playing field, each first playing field includes a rectangular grid defined by a predetermined number of first rows and a further number of first columns defining a matrix of first spaces, wherein the first spaces are defined by a first width, and each first playing field including a second playing field, wherein the second playing field is pivotally mounted to the first playing field, the second playing field defining a rectangular grid with a predetermined number of first rows and further predetermined number of first columns to define a matrix of second spaces, wherein each of the second spaces include a peg receiving aperture positioned medially thereof, and each second playing field including an upper edge defined by a first upper edge positioned within the first support housing, and a second upper edge positioned within the second housing, wherein the first upper edge and the second upper edge are positioned in coextensive adjacency relative to one another in an erected configuration, and each first playing field of each support housing including a first and second wing flange hingedly mounted to opposed sides of each first playing field, each respective first and second wing flange including respective first and second wing upper edge, and a first intersection defined by the first and second wing upper edge positioned on opposed ends of the respective first and second upper edge, and a first "T" shaped locking member mounted to each intersection, and each "T" shaped locking member includes a first channel to receive confronting first and second wing upper edges, and a second channel and a third channel, the second channel and third channel arranged parallel relative to one another and orthogonally intersecting the first channel, wherein the second channel and the third channel slidably receive the first and second upper edges therewithin, and each first playing field of each support housing includes a first plurality of first tokens, a second plurality of second tokens, and a third token, each first token is defined by a first token length to span at least two first spaces, the second token length is defined to span at least three first spaces, and the third token length is arranged to span at least four first spaces, and the second token includes a first base plate, the first base plate mounting a plurality of projectiles thereon, each projectile defined by a predetermined length, and the first base plate including a carriage block fixedly mounted thereon, the carriage block defined by a block cavity, the block cavity pivotally mounting a catapult lever at a lower terminal end of the catapult lever, and the catapult lever including a concave medial surface projecting above the block cavity, the concave surface defined by a surface length equal to the predetermined length of said projectiles, and the third token includes a third token base plate, the third token base plate includes a plurality of triangular polygonal members hingedly mounted thereon, each triangular polygonal member arranged to overlie a spring positioned medially of each triangular polygonal member and the third token base plate, and a clip member to secure the first and second polygonal members together, and the catapult lever includes an abutment leg mounted fixedly to a bottom surface of the catapult lever and received within the block cavity, wherein the block cavity is defined by a cavity height and the abutment leg is defined by a predetermined leg length substantially equal to or greater than the cavity height to limit pivotment of the catapult lever relative to the carriage block.

* * * * *